US006511295B2

(12) United States Patent
Suitou et al.

(10) Patent No.: US 6,511,295 B2
(45) Date of Patent: Jan. 28, 2003

(54) COMPRESSORS

(75) Inventors: Ken Suitou, Kariya (JP); Kazuya Kimura, Kariya (JP); Masahiro Kawaguchi, Kariya (JP); Masanori Sonobe, Kariya (JP); Ryo Matsubara, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/989,615

(22) Filed: Nov. 20, 2001

(65) Prior Publication Data

US 2002/0062656 A1 May 30, 2002

(30) Foreign Application Priority Data

Nov. 24, 2000 (JP) ..... 2000-357967

(51) Int. Cl.[7] ..... F04B 49/06; F25D 23/12
(52) U.S. Cl. ..... 417/44.1; 62/259.2
(58) Field of Search ..... 417/44.1, 410.1, 417/410.5, 902; 62/259.2

(56) References Cited

U.S. PATENT DOCUMENTS 3,903,710 A * 9/1975 Quatman
5,220,809 A * 6/1993 Voss ..... 62/259.2
6,041,609 A * 3/2000 Hornsleth et al. ..... 62/259.2

FOREIGN PATENT DOCUMENTS

| | | | |
|---|---|---|---|
| JP | 62-12471 | * | 1/1987 |
| JP | 62-19535 | * | 2/1987 |
| JP | 4-80554 | * | 3/1992 |
| JP | 2000-255252 | | 9/2000 |

* cited by examiner

*Primary Examiner*—Michael Koczo
(74) *Attorney, Agent, or Firm*—Morgan & Finnegan, LLP

(57) ABSTRACT

Compressors may include a compressor housing having a compression chamber defined within the compressor housing. The compression chamber is preferably arranged and constructed to compress and discharge a fluid drawn into the compression chamber. A unit housing may be coupled to the compressor housing. A control device may be disposed within the unit housing and the control device preferably controls electric components of the compressor. Further, a suction passage is preferably defined to introduce the fluid into the compression chamber. The suction passage preferably penetrates through the unit housing so as to directly cool the control device due to the fluid flowing through the suction passage.

20 Claims, 4 Drawing Sheets

COMPRESSORS

BACKGROUND OF THE INVENTION

1. Field of the Invention

The present invention relates to compressors and more particularly, to compressors that include electrical driven devices, such as an electric motor for driving the compressor.

2. Description of the Related Art

A known compressor is disclosed in Japanese Laid-Open Patent Publication No. 2000-255252 and includes an electric motor and an inverter. The inverter controls the electric motor in order to drive the compressor. Further, the inverter is cooled by refrigerant gas drawn into the compressor. More specifically, the inverter includes a heat radiator that contacts a suction passage for drawing the refrigerant into the compressor and the heat radiator cools the inverter.

SUMMARY OF THE INVENTION

It is one object of the present teachings to provide improved compressors that can more effectively cool an electrical control device of the compressor.

In one embodiment of the present teachings, representative compressors may include, for example, a compressor housing, a compression chamber, a unit housing, a control device and a suction passage. The compression chamber may be defined within the compressor housing and fluid drawn into the compression chamber is compressed and then discharged. The control device may be disposed within the unit housing and the control device preferably controls electric devices within the compressor. For example, an electric motor may be disposed within the compressor housing and may drive the compressor. Further, an inverter is one representative example of a control device according to the present teachings.

The suction passage may introduce fluid, such as a refrigerant gas, into the compression chamber. The temperature of fluid within the suction passage is typically relatively low compared to the temperature of the fluid that has been compressed by and discharged from the compressor. Preferably, the suction passage penetrates into the unit housing such that the fluid within the suction passage may directly cool the control device (e.g., an inverter) disposed within the unit housing.

If the suction passage penetrates into the unit housing, the control device within the unit housing can be directly and effectively cooled. Although the fluid in the suction passage can directly cool the control device, the control device is prevented from being directly exposed to the fluid due to separation provided by the suction passage. Therefore, the control device can be prevented from corroding, which may cause the control device to malfunction.

Only objects, features and advantage of the present invention will be readily understood after reading the following detailed description together with the accompanying drawings and the claims.

DETAILED DESCRIPTION OF THE INVENTION

Figure 1:
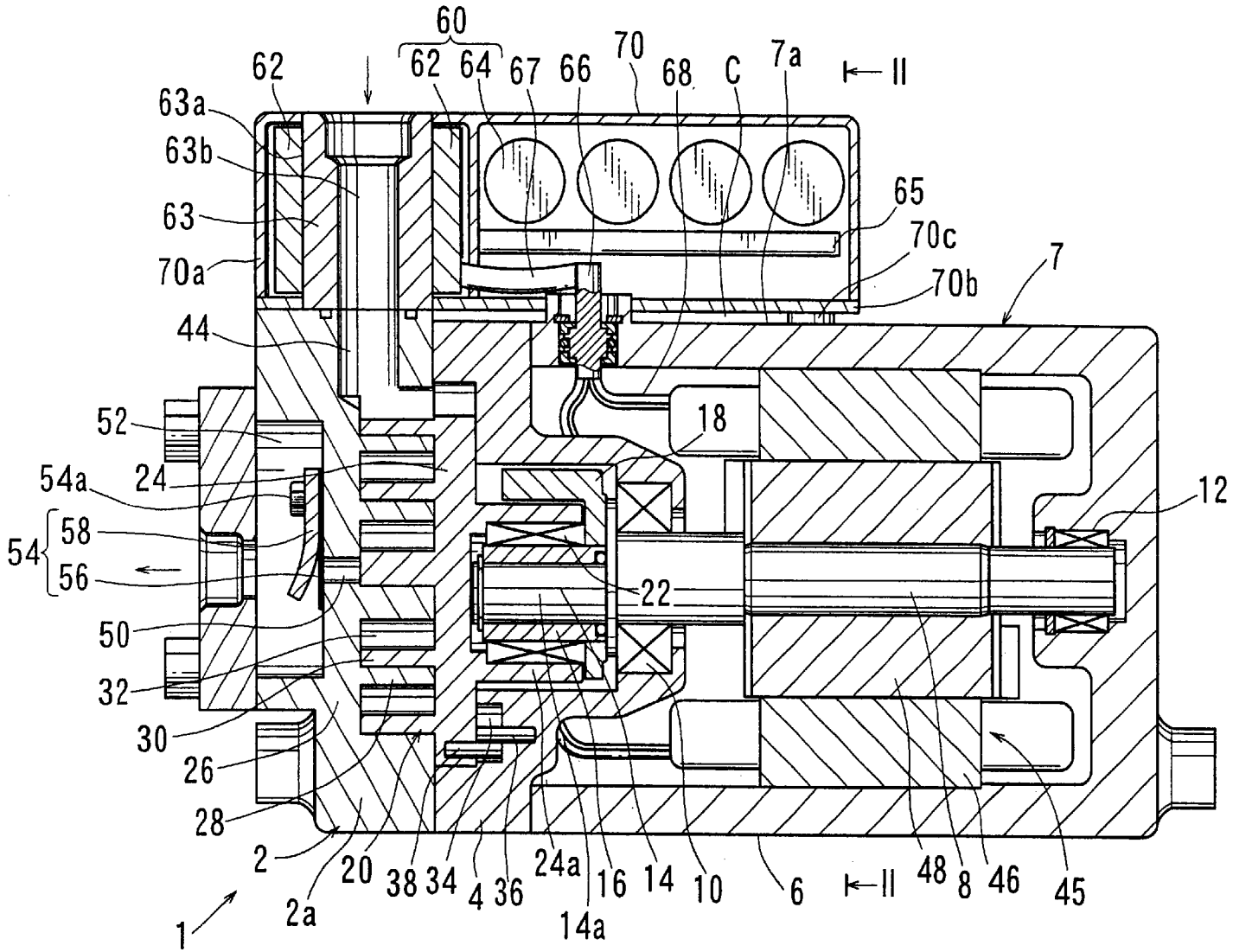
FIG. 1 shows a representative scroll compressor.

Representative compressors are taught that may preferably include a compressor housing. A compression chamber may be defined within the compressor housing. A unit housing may be disposed proximally to the compressor housing and a control device may be disposed within the unit housing. The control device preferably functions to control the electric components of the compressor. A suction passage preferably penetrates through the unit housing so as to provide an effective surface for directly cooling the control device.

In one embodiment of the present teachings, an adiabatic zone may preferably be provided between the compressor housing and the unit housing. In another embodiment of the present teachings, the unit housing may preferably be disposed on or adjacent to the outer surface of the compressor housing. Preferably, an electric motor drives the compressor in accordance with signals communicated by the control device, which may be, e.g., an inverter. In another embodiment of the present teachings, the position of the adiabatic zone may be chosen in accordance with the disposition of the electric components of the compressor.

In further embodiment of the present teachings, the adiabatic zone may be defined by an air-layer provided between the compressor housing and the unit housing. Optionally, the adiabatic zone may comprise a heat sink material. In another embodiment, a heat insulating material may be disposed within the unit housing.

In another aspect of the present teachings, heat-generating elements of the control device may preferably be disposed within the unit housing in a position that is close to and outer surface of the suction passage. For example, heat-generating device(s) may be disposed so as to contact directly the outer surface of the suction passage or a clearance may separate the heat-generating device(s) from the outer surface of the suction passage.

In another aspect of the present teachings, the outer surface of the suction passage may substantially conform to the outer shape of the heat-generating elements. For example, the outer surface of the suction passage may include a planar surface. Moreover, the suction passage may preferably include a plurality of mounting surfaces disposed in the circumferential direction of the suction passage. Thus, the heat-generating elements may be disposed on the respective mounting surfaces.

Each of the additional features and method steps disclosed above and below may be utilized separately or in conjunction with other features and method steps to provide improved compressors and methods for designing and using such compressors. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings. Further, the features disposed in the specification and dependent claims may be combined in ways that are not specifically enumerate in order to provide additional useful embodiments of the present teachings.

Figure 2:
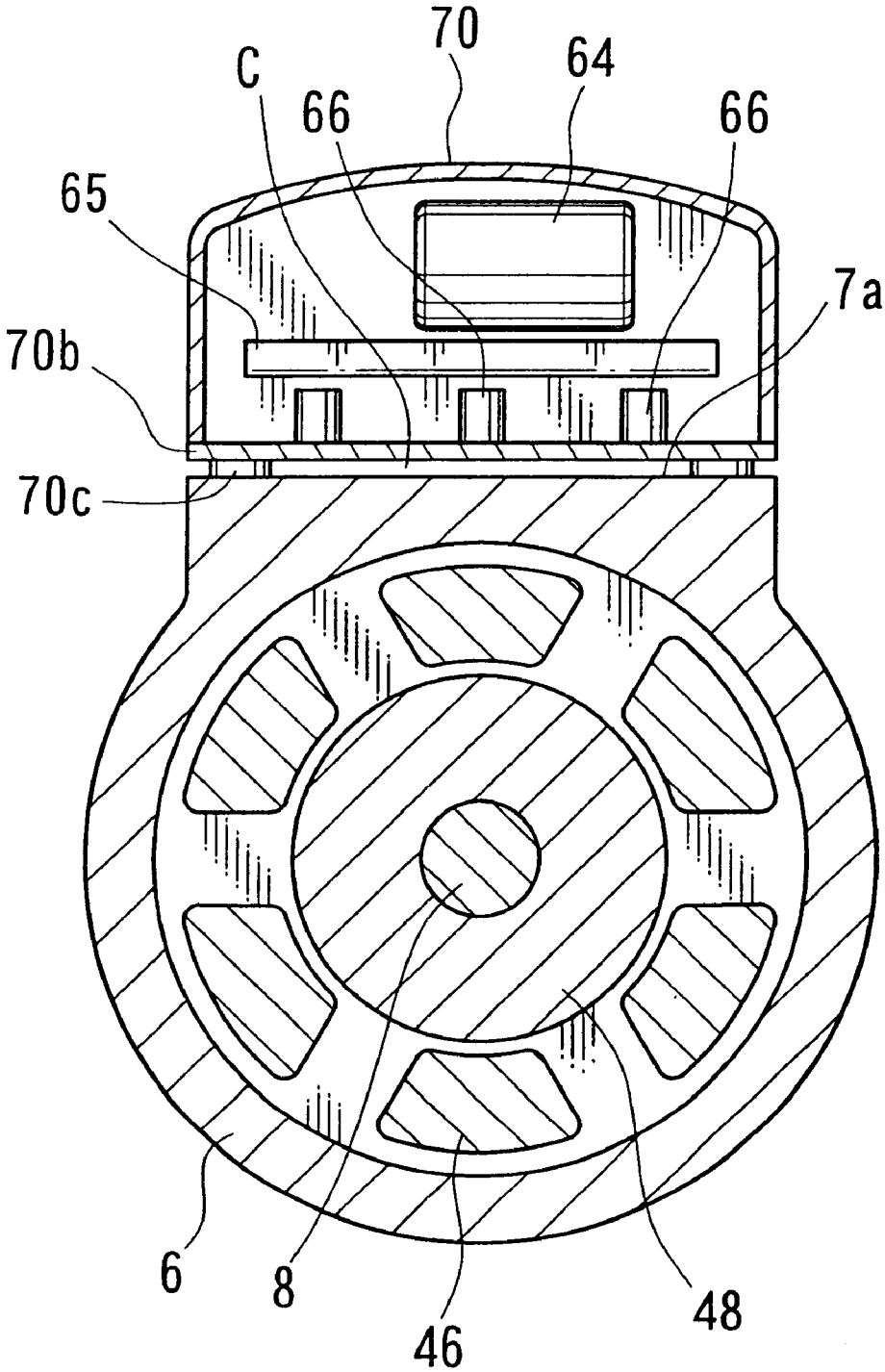
FIG. 2 shows a cross sectional view taken along line II—II in FIG. 1.
Figure 3:
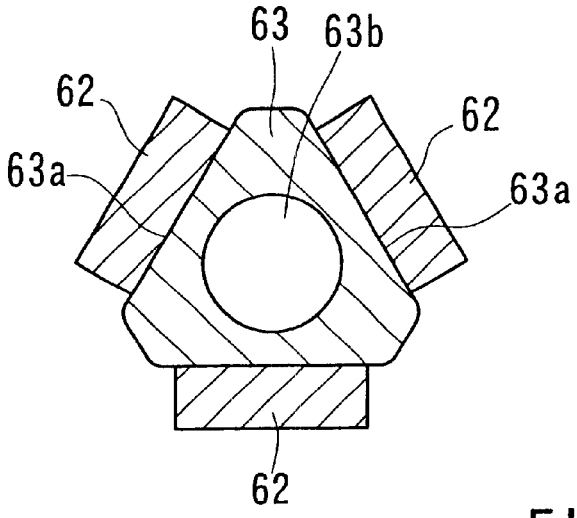
FIG. 3 shows a representative disposition for the respective switching elements.

A representative compressor is shown in FIGS. 1 to 3 and may preferably be utilized within a refrigerant circulation circuit in a vehicle air conditioning system. As shown in FIG. 1, a representative compressor 1 may include a compressor housing 7, a compression chamber 32 defined between a stationary scroll 2 and a movable scroll 20 within the compressor housing 7. An electric motor 45 may be provided within the compressor housing 7 in order to drive the movable scroll 20. An inverter 60 may be within a unit housing 70 and a suction passage 63 may penetrate through the unit housing 70 in order to directly cool the inverter 60. As discussed above, an inverter is one representative example of a "control device" or a "means for controlling" according to the present teachings.

The compressor housing 7 may include a center housing 4, a motor housing 6 and an end housing 2*a*. A stationary scroll 2 is provided within the end housing 2*a*. A movable scroll 20 and other appropriate devices for driving the movable scroll 20 are disposed within the compressor housing 7. A first end surface of the center housing 4 is coupled to the end housing 2*a* and a second end surface of the center housing 4 is coupled to the motor housing 6. A drive shaft 8 is rotatably supported by radial bearings 10 and 12 respectively disposed within the center housing 4 and the motor housing 6. Within the center housing 4, a crankshaft 14 is integrally coupled to the end of the drive shaft 8. Although the drive shaft 8 is driven by an electric motor 45 disposed in the motor housing 6 in this representative embodiment, the present teachings are also, e.g., naturally applicable to other types of scroll compressors, as well as compressors in general, in which the drive shaft 8 is mechanically driven by the vehicle engine via belts.

Two mutually parallel planar portions 14*a* are defined on the crankshaft 14. In FIG. 1, however, only one planar portion 14*a* is shown for the sake of convenience of explanation. A bush 16 is disposed around the planar surfaces 14*a* so that the bush 16 may rotate together with the crankshaft 14. A balancing weight 18 is attached to one end of the bush 16 so that the balancing weight 18 can rotate together with the crankshaft 14. The movable scroll 20 includes a tubular boss 24*a* on the surface opposite to the stationary scroll 2 (on the right side of the movable scroll 20 in FIG. 1). Further, the bush 16 is connected to the inner circumferential surface of the boss 24*a* by means of a needle bearing 22. The needle bearing 22 is coupled to the inner circumferential surface of the boss 24*a* by means of a stopper ring (not particularly shown in the drawings).

The stationary scroll 2 includes a stationary volute wall 28 that protrudes from a base plate 26 of the stationary scroll 2 towards the movable scroll 20. The movable scroll 20 includes a movable volute wall 30 that protrudes from the base plate 24 of the movable scroll 20 towards the stationary scroll 2. The stationary volute wall 28 and the movable volute wall 30 are disposed adjacent to each other and preferably are aligned to engage or mesh with each other. The volute walls are also known in the art as spiral wraps and naturally, these terms can be utilized interchangeably.

The stationary volute wall 28 and the movable volute wall 30 make contact with each other at a plurality of positions and are positioned in meshing engagement. As the result, a plurality of compression chambers 32 having a crescent shape is defined within a space surrounded by the stationary scroll base plate 26, the stationary volute wall 28, the movable scroll base plate 24 and the movable volute wall 30. When the drive shaft 8 rotates, the crankshaft 14 revolves or orbits around the rotational axis of the drive shaft 8. The rotational axis may be defined as the center, longitudinal axis of the drive shaft 8. Thus, the distance between the crankshaft 14 and the rotational axis of the drive shaft 8 defines the diameter of the orbital path. When the movable scroll 20 revolves or orbits about the rotational axis of the drive shaft 8, the balancing weight 18 offsets the centrifugal force caused by the revolution of the movable scroll 20. The crank shaft 14 that rotates together with the drive shaft 8, the bush 16, the needle bearing 22 provided between the crank shaft 14 and the boss 24*a* of the movable scroll 20 define a revolutionary (orbital) mechanism 19 to transmit the rotational torque of the drive shaft 8 to the movable scroll 20 as a revolutionary (orbital) movement.

A discharge port 50 is defined within the base plate 26 of the stationary scroll 2. Further, a discharge valve 54 is provided within a discharge chamber 52. The discharge valve 54 is disposed to face the discharge port 50 in order to open and close the discharge port 50. The discharge valve 54 includes a reed valve 56 and a retainer 58. The reed valve 56 has a shape that is sufficient to cover the opening of the discharge port 50. The retainer 58 faces the reed valve 56 and is disposed on the opposite side of the discharge port 50. Within the discharge chamber 52, the reed valve 56 and the retainer 58 are fixed to the inner surface of the base plate 26 of the stationary scroll 2 by means of a bolt 54*a*.

The reed valve 56 is opened and closed based upon the pressure difference between the pressure within the discharge port 50 or the compression chamber 32 and the pressure within the discharge chamber 52. The retainer 58 supports the reed valve 56 and also defines the maximum aperture of the reed valve 56.

A plurality of spaces (recesses) 34 are provided at equal angles within the center housing 4 to face base plate 24 of the movable scroll 20. First auto-rotation preventing pins 36 and second auto rotation preventing pins 38 are disposed within respective spaces 34. The first auto-rotation preventing pins 36 are fixed to the center housing 4 and penetrate from the center housing 4 toward the movable scroll 20. The second auto-rotation preventing pins 38 are fixed to the movable scroll 20 and protrude from the base plate 24 of the movable scroll 20 to the center housing 4 within the space 34. In this embodiment, a total of four first auto-rotation preventing pins 36 and second auto-rotation preventing pins 38 are provided. However, only one of each of the first and second auto-rotation preventing pins 36, 38 are shown in FIG. 1. Auto-rotation of the movable scroll 20 can be prevented by the engagement of the first auto-rotation preventing pins 36 with the second auto-rotation preventing pins 38.

With respect to the electric motor 45, a stator 46 is provided on the inner circumferential surface of the motor housing 6. Further, a rotor 48 is coupled to the drive shaft 8. The stator 46 and the rotor 48 define an electric motor that rotates the drive shaft 8. Thus, the present scroll compressors are particularly useful for hybrid or electric cars that operate using electric power. However, an electric motor is not essential to the present teachings and the present scroll compressor can be modified for use with internal combustion engines.

In the representative compressor 1 as described above, the compressor housing 7 has a flat-shaped attachment surface 7*a* defined on the outer upper surface of the compressor housing 7. Preferably, the unit housing 70 is coupled to the attachment surface 7*a*. As shown in FIG. 1, an attachment plate 65 supports a plurality of condensers (capacitors) 64. The inverter 60 may be disposed within the unit housing 70 and preferably includes two elements. The first element may be a relatively high heat-generating element, such as switching element 62, which generate a relatively large amount of heat. The second element may be a relatively low heat-generating element, such as condenser 64, which generates a relatively small amount of heat.

The switching elements 62 are preferably disposed within a cylindrical portion 70*a* of the unit housing 70. As shown in FIG. 1, the suction passage 63 preferably penetrates through the unit housing 70 and may include a cylindrical member 63*a* and a refrigerant introducing passage 63*b*. The refrigerant introducing passage 63*b* is defined inside the cylindrical member 63*a*. The switching elements 62 preferably directly contact the outer surface of the refrigerant introducing passage 63*b* of the suction passage 63.

FIG. 3 shows a cross-sectional view of the suction passage 63, in which a plurality of flat-shaped attachment surfaces 63*c* are disposed around the outer periphery of the cylindrical member 63*a* in order to couple the respective switching elements 62 onto the attachment surfaces 63*c*. In this representative embodiment, three attachment surfaces 63*c* are formed so as to form a triangular shape.

As shown in FIG. 1, a first end of the suction passage 63 communicates with the suction port 44 of the compressor chamber 32. A second end of the suction passage 63 communicates with the refrigerant-returning line (omitted from the drawings) of the external air conditioning circuit.

The unit housing 70 preferably comprises a heat insulating material, such as a synthetic resin. A connecting member 70*c* may be utilized to attach the bottom plate 70*b* to the attachment surface 7*a* of the compressor housing 7. A clearance C may be defined between the unit housing 70 and the compressor housing. Further, clearance C is one representative example of an "adiabatic zone defined by an air layer" according to the present teachings.

The switching elements 62 in the unit housing 70 and the electric motor 45 within the motor housing 6 are electrically connected by a conducting pin 66 and a conducting wires 67 and 68. The conducting pin 66 extends through the unit housing 70 and the compressor housing 7. Electric power to drive the electric motor 45 is supplied from the switching elements 62 via the conducting pin 66 and the conducting wires 67, 68.

The drive shaft 8 is rotated by means of the electric motor 45. The electric motor 45 is operated by the inverter 60 disposed within the unit housing 70. When the crank shaft 14 orbits, the movable scroll 20, which is connected to the crank shaft 14 by the boss 24*a* and the needle bearing 22, orbits around the rotational axis of the drive shaft 8. When the movable scroll 20 orbits with respect to the stationary scroll 2, refrigerant gas (fluid) is drawn from the suction passage 63 into the compression chamber 32 via a suction port 44. The compression chamber 32 reduces the volume of the refrigerant gas as the compression chamber moves toward the center of the scrolls 2, 20. Due to the volume reduction of the compression chamber 32 and thus the refrigerant gas, the refrigerant gas is compressed and reaches a high-pressure state. The compressed high-pressure refrigerant gas is discharged from the discharge port 50 to the cooling or heating circuit of the vehicle air-conditioning system (not particularly shown in the drawings) via the discharge chamber 52 when the discharge valve 54 opens the discharge port 50.

The compressed high-pressure refrigerant gas is discharged from the discharge port 50 to the air conditioning system outside of the compressor 1 via a discharge chamber 52 when the discharge valve 54 opens the discharge port 50. Although it is not particularly shown in the drawings, the high-pressure refrigerant discharged from the representative compressor 1 may be supplied to an air conditioning system that includes a condenser, expansion valve and an evaporator. Then, the refrigerant will be again drawn into the compressor 1 via the suction passage 63 and the suction port 44. The refrigerant, which has a relatively low-pressure and low-temperature within the suction passage 63, will then absorb the heat generated by the switching elements 62 within the unit housing 70. Thus, the heat generating elements, such as switching elements 62, can be directly and quickly cooled by means of the refrigerant gas flowing through the suction passage 63. Naturally, because the refrigerant gas passing through the suction passage 63 directly cool the heat generating elements in the unit housing 70, no special heat-dissipating equipment, such as a heat radiator, is required to cool the heat generating elements.

According to this representative embodiment, the suction passage 63 directly contacts only the high heat-generating elements, such as the switching elements 62, disposed within the unit housing 70. In other words, by functionally separating the inverter 60 into two portions, i.e., high and low heat-generating elements, and by selectively cooling only the high heat-generating elements, the cooling efficiency of the inverter can be maximized. Moreover, as particularly shown in FIG. 3, the suction passage 63 includes a plurality of the planar surfaces 63*c* and the flat-shaped switching elements 62 can be coupled to the flat attachment surfaces 63*c*. Therefore, the effective area for cooling the switching elements 62 by the refrigerant gas can be effectively increased.

During the operation of the compressor 1, the temperature of the compressor housing 7 tends to rise due to the heat generated by the compression of refrigerant gas and due to the heat generated by the electric motor 45. However, due to the adiabatic zone defined by the clearance C between the unit housing 70 and the compressor housing 7, the unit housing 70 can be thermally insulated from the compressor housing 7. Therefore, the inverter 60 within the unit housing 70 can be prevented from being heated by the compressor housing 7. Further, because the unit housing 70 is formed using a heat insulating material (e.g., a synthetic resin), the unit housing 70 can effectively shield the inverter 60 from the heat radiated by the compressor housing 7.

On the other hand, when the operation of the compressor 1 is stopped, the refrigerant gas is not compressed and circulated. Therefore, the inverter 60 can not be cooled by the refrigerant gas flowing through the suction passage 63 when the compressor 1 is not operated. However, in such case, due to the adiabatic zone C and the unit housing 70 formed from an insulating material, the temperature of inverter 60 within the unit housing 70 can be prevented from rising due to the heat radiated by the compressor housing 7.

Because the temperature of the compressor housing 7 will sharply rise when an electric motor 45 is utilized to drive the compressor 1, the adiabatic zone C may preferably be provided between the compressor housing 7 and the unit housing 70 so as to separate the unit housing 70 from the compressor housing 7. In this connection, the unit housing 70 is separated from the compressor housing 7 by a minute or small clearance and this clearance defines the adiabatic zone C. According to this representative embodiment, because the unit housing 70 is separated from the compressor housing 7 only by the adiabatic zone C, the length of the electric circuit that is required to connect the electric motor 45 with the inverter 60 can be minimized. Furthermore, the length of the suction passage 63 for cooling the inverter 60 can be also minimized. Thus, the refrigerant gas within the air conditioning circuit can be prevented from receiving relatively high resistance caused by friction between the flowing refrigerant gas and the inside wall of the circuit pipe.

Figure 4:
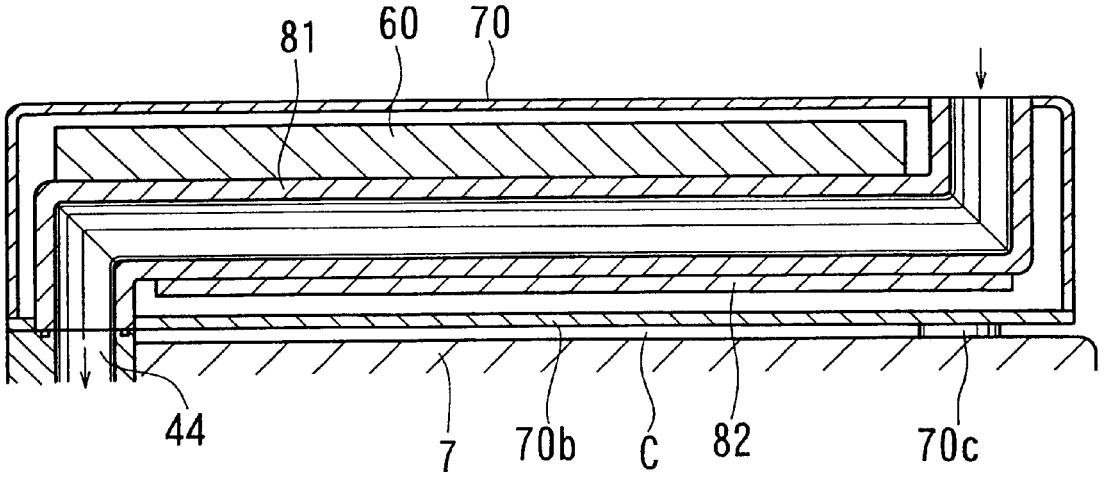
FIG. 4 shows a cross sectional view of a modification of the representative embodiment.

A second representative embodiment is shown in FIG. 4. The second representative embodiment relates to a modification of the disposition of the suction passage with respect to the unit housing. As shown in FIG. 4, in the second representative embodiment, the suction passage 81 is horizontally provided within the unit housing 70. That is, the suction passage 81 is disposed substantially in parallel with the surface of the compressor housing 7. The suction passage 81 directly contacts the inverter 60 (electric elements) within the unit housing 70 and the tip of the suction passage 81 communicates with the suction port 44. The bottom plate 70*b* of the unit housing 70 is coupled to the compressor housing 7 by means of an attaching member 70*c*. An adiabatic zone C is defined between the unit housing 70 and the compressor housing 7. In other words, the unit housing 70 is separated from the compressor housing 7 by a clearance C. Further, in the second representative embodiment, a heat-sink material 82 is preferably provided on the outer surface of the suction passage 81 and absorbs heat radiated from the compressor housing 7 in order to prevent the temperature of the inverter 60 from excessively rising.

Figure 5:
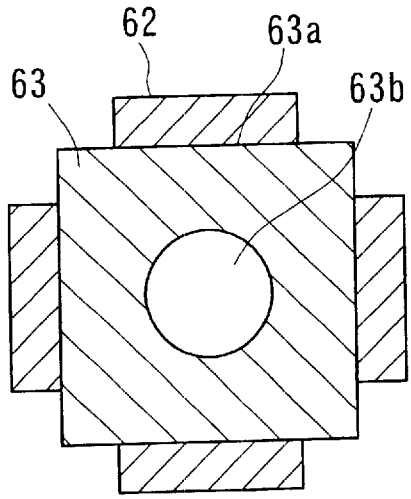
FIG. 5 shows a modification of the arrangement of the switching elements.
Figure 6:
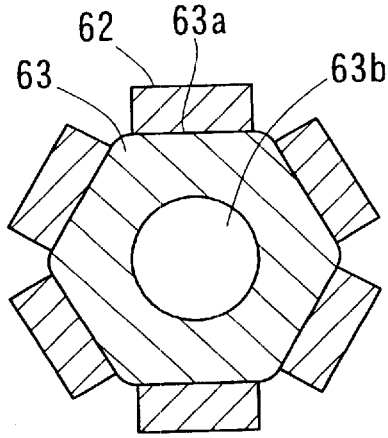
FIG. 6 shows another modification of the arrangement of the switching elements.
Figure 7:
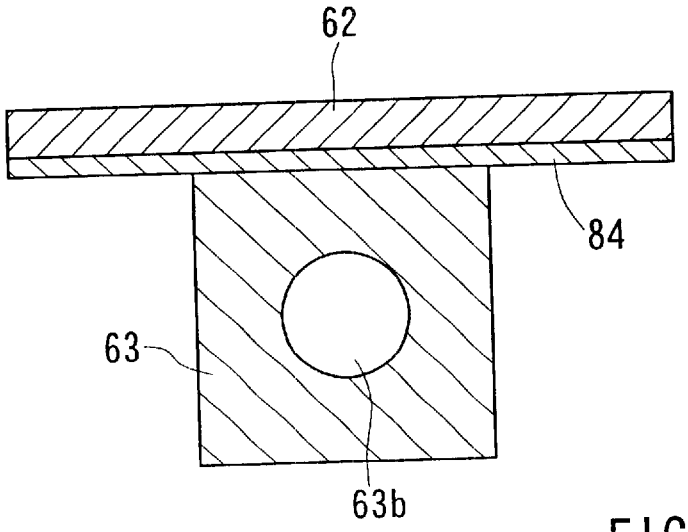
FIG. 7 shows a further modification of the arrangement of the switching elements.

Various modifications of the representative embodiment with respect to the suction passage are shown in FIGS. 5 to 7. According to the modification as shown in FIG. 5, the cylindrical member 63 may have a square cross section and four attachment surfaces 63*a*. According to the modification as shown in FIG. 6, the cylindrical member 63 may have a hexagonal cross section and six attachment surfaces 63*a*. According to the modification as shown in FIG. 7, a plate-shaped heat-radiating member 84 may be provided between the cylindrical member 63 and the switching element 62. The heat radiation member 84 will permit heat to efficiently transfer between the switching element 62 and the cylindrical member 63.

Naturally, further modifications can be made with respect to the above-described representative embodiments. For example, in the adiabatic zone between the unit housing 70 and housing 7, a heat insulating material can be utilized instead of the air-layer defined by the clearance C between the unit housing 70 and the compressor housing 7. Further, the adiabatic zone can be defined by a combination of a heat sink material and a heat insulating material. Moreover, the attachment surfaces 63*a* of the suction passage for attaching the switching element 62 are not limited to flat-shaped surfaces. That is, the switching element 62 and the cylindrical unit 63 may have any mating surface. Further, this invention is applicable to compressors other than the scroll type compressor that was described above.

Further additional teachings that are relevant to the present teachings can be found in U.S. patent application Ser. No. 09/804,219, which teachings are incorporated by reference herein in their entirety.

What is claimed is:

1. A compressor comprising:

a compressor housing having a compression chamber defined within the compressor housing, wherein the compression chamber is arranged and constructed to compress and discharge a fluid drawn into the compression chamber, a unit housing coupled to the compressor housing, a control device disposed within the unit housing, wherein the control device controls electric components of the compressor and a suction passage defined to introduce the fluid into the compression chamber, wherein the suction passage penetrates through the unit housing so as to directly cool the control device due to the fluid flowing through the suction passage.

2. A compressor according to claim 1 further comprising an adiabatic zone that is defined between the compressor housing and the unit housing.

3. A compressor according to claim 2, wherein the unit housing is disposed on or adjacent to the outer surface of the compressor housing via the adiabatic zone, the control device operates the electric components that are disposed within the compressor housing.

4. A compressor according to claim 2, wherein the adiabatic zone is defined between an outer surface of the compressor housing and the unit housing.

5. A compressor according to claim 1, wherein the electric components include an electric motor disposed within the compressor housing and causing the compression chamber to compress and discharge the fluid.

6. A compressor according to claim 5, wherein the adiabatic zone is disposed proximally to the electric motor.

7. A compressor according to claim 5, wherein the adiabatic zone is defined by an air-layer provided between the compressor housing and the unit housing.

8. A compressor according to claim 5, wherein the adiabatic zone comprises a heat sink material.

9. A compressor according to claim 1, further comprising a heat insulating material disposed within the unit housing.

10. A compressor according to claim 1, wherein the control device includes relatively high heat-generating elements that are disposed on an outer surface of the suction passage.

11. A compressor according to claim 10, wherein the outer surface of the suction passage conforms to an outer shape of the heat-generating elements.

12. A compressor according to claim 10, wherein the outer surface of the suction passage includes a planar surface.

13. A compressor according to claim 10, wherein a plurality of mounting surfaces are disposed in the circumferential direction of the suction passage and the heat-generating elements are disposed on the respective mounting surfaces.

14. A compressor according to claim 10, wherein a heat radiator is disposed between the suction passage and the heat-generating elements.

15. A compressor according to claim 1, wherein the control device comprises relatively high heat generating switching elements, wherein the switching elements are directly mounted on the suction passage.

16. A compressor according to claim 15, wherein the control device further comprises a plurality of condensers that are spaced from the suction passage.

17. A compressor according to claim 16, further comprising an adiabatic zone defined between an outer surface of the compressor housing and the unit housing, an electric motor disposed within the compressor housing and causing the compression chamber to compress and discharge the fluid and a heat insulating material disposed within the unit housing so as to shield the control device from heat radiated by the compressor housing.

18. A compressor comprising:

a compressor housing, a compression chamber defined within the compressor housing, the compression chamber compressing and discharging fluid drawn into the compression chamber, a unit housing coupled to the compressor housing, a control device disposed within the unit housing, wherein the control device controls electric components of the compressor and means for directly cooling the control device within the unit housing, wherein the cooling means defines a portion of an air conditioning system that penetrates through the unit housing.

19. A compressor according to claim 18, wherein the control device comprises relatively high heat generating switching elements, wherein the switching elements are directly mounted on the cooling means, and a plurality of condensers that are spaced from the cooling means and further comprising an adiabatic zone defined between an outer surface of the compressor housing and the unit housing, an electric motor disposed within the compressor housing and causing the compression chamber to compress and discharge the fluid and a heat insulating material disposed within the unit housing so as to shield the control device from heat radiated by the compressor housing.

20. A method comprising passing the fluid through the suction passage disposed within the compressor of claim 1 in order to directly cool the control device disposed within the unit housing.

* * * * *